US007639973B2

(12) United States Patent
Sano et al.

(10) Patent No.: US 7,639,973 B2
(45) Date of Patent: Dec. 29, 2009

(54) IMAGE FORMING APPARATUS WITH DEVELOPER SUPPLY ROLLER

(75) Inventors: Tetsuo Sano, Toyokawa (JP); Yohei Nakade, Okazaki (JP); Ichiro Demizu, Toyonaka (JP); Yoshikazu Aoki, Toyokawa (JP); Yuusuke Okuno, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 237 days.

(21) Appl. No.: 11/808,881

(22) Filed: Jun. 13, 2007

(65) Prior Publication Data

US 2007/0286648 A1 Dec. 13, 2007

(30) Foreign Application Priority Data

Jun. 13, 2006 (JP) ..... 2006-163057

(51) Int. Cl.
*G03G 15/08* (2006.01)

(52) U.S. Cl. ..... 399/281; 399/283

(58) Field of Classification Search ..... 399/272, 399/273, 281, 283, 284, 286
See application file for complete search history.

(56) References Cited

U.S. PATENT DOCUMENTS 5,655,197 A * 8/1997 Okada et al. ..... 399/281
6,345,166 B1 * 2/2002 Sakaizawa et al. ..... 399/283
6,810,227 B2 10/2004 Sakata et al.
6,829,464 B2 * 12/2004 Haraguchi et al. ..... 399/281
2001/0036376 A1 11/2001 Yamazaki et al.

FOREIGN PATENT DOCUMENTS

| | | |
|---|---|---|
| JP | 2001-290363 | 10/2001 |
| JP | 2003-162142 | 6/2003 |
| JP | 2003-192756 | 7/2003 |
| JP | 2003-228230 A | 8/2003 |

OTHER PUBLICATIONS

Notification of Reason(s) for Refusal in JP 2006-163057 dated Apr. 15, 2008, and Translations thereof.

* cited by examiner

*Primary Examiner*—Hoang Ngo
(74) *Attorney, Agent, or Firm*—Buchanan Ingersoll & Rooney PC

(57) ABSTRACT

An image forming apparatus has an electrostatic latent image bearing member capable of bearing an electrostatic latent image thereon, and a developer apparatus having a developer material for visualizing the electrostatic latent image into a visualized image. The developer apparatus includes a developer material bearing member, a housing adapted to accommodate a developer material, and a supply roller adapted to supply the developer material within the housing for the developer material bearing member. The supply roller has an outer circumferential foam layer. The foam layer is made of resin foam or rubber foam and has an air permeability of 5 $ml/cm^2/s$ or less, a density of 50-200 $kg/m^3$, and a hysteresis loss ratio of 35-45%.

15 Claims, 4 Drawing Sheets

FIG.5

TEST RESULTS

| | Conductive Agent | Air Permeability ($ml/cm^2/s$) | Density ($kg/m^3$) | Hysteresis Loss Ration (%) | Resistence (Ω) | Average Effective Cell Diamter (μm) | Evaluation | Implantation | Scraping | Dropping | Problems |
|---|---|---|---|---|---|---|---|---|---|---|---|
| Invention Example 1 | I | 0.7 | 115 | 43 | $3.0\times10^{8}$ | 280 | A | A | A | A | |
| Invention Example 2 | I | 1.4 | 90 | 41 | $2.5\times10^{7}$ | 350 | A | A | A | A | |
| Invention Example 3 | I | 2.5 | 70 | 38 | $2.1\times10^{7}$ | 420 | A | A | A | A | |
| Invention Example 4 | I | 4.6 | 50 | 35 | $2.0\times10^{7}$ | 500 | A | A | A | A | |
| Invention Example 5 | C | 0.6 | 128 | 44 | $5.3\times10^{3}$ | 270 | A | A | A | A | |
| Invention Example 6 | I | <0.32 | 190 | 45 | $3.0\times10^{8}$ | 230 | A | A | A | A | |
| Comparison Example 1 | I | 6 | 40 | 36 | $2.7\times10^{7}$ | 420 | C | A | C | C | |
| Comparison Example 2 | I | 4.8 | 45 | 35 | $2.9\times10^{8}$ | 460 | C | A | C | C | |
| Comparison Example 3 | I | <0.32 | 300 | 46 | $3.0\times10^{6}$ | 170 | C | C | C | C | *1 |
| Comparison Example 4 | I | 6 | 250 | 50 | $2.8\times10^{7}$ | 180 | C | C | C | C | *1 |
| Comparison Example 5 | I | 2.5 | 60 | 33 | $2.5\times10^{6}$ | 390 | B | A | A | B | |
| Comparison Example 6 | I | 6 | 125 | 44 | $2.6\times10^{7}$ | 250 | C | A | A | C | |
| Comparison Example 7 | I | 7 | 180 | 33 | $5.5\times10^{7}$ | 200 | C | A | A | C | *1 |
| Comparison Example 8 | I | 2.8 | 210 | 40 | $4.3\times10^{8}$ | 180 | C | C | A | A | *1 |
| Comparison Example 9 | I | 1.7 | 110 | 48 | $7.8\times10^{7}$ | 350 | C | A | C | C | |
| Comparison Example 10 | I | 1 | 160 | 38 | $2.5\times10^{7}$ | 220 | B | A | A | A | *1 |
| Comparison Example 11 | None | 0.5 | 120 | 44 | $1.0\times10^{10}$ | 280 | B | A | A | A | *1,*2 |
| Comparison Example 12 | C | 0.6 | 128 | 45 | $2.0\times10^{2}$ | 260 | B | A | A | A | *3 |

I : Ionic Conductive Agent
C : Carbon Black

*1: Insufficient Density
*2: Image Defect
*3: Noise

IMAGE FORMING APPARATUS WITH DEVELOPER SUPPLY ROLLER

RELATED APPLICATION

This application is based upon the Japanese Patent Application Serial No. 2006-163057, the entire disclosure of which is incorporated herein by reference.

FIELD OF THE INVENTION

The present invention relates to an image forming apparatus such as a copy machine, a printing machine, a facsimile machine and a multi-function machine equipped with functions of those machines. The present invention also relates to a developer device for developing an electrostatic latent image on an electrostatic latent image bearing member of the image forming apparatus. The present invention further relates to a developer material supply roller for supplying developer material, such as toner particles, to a developer material bearing member of the image forming apparatus.

BACKGROUND OF THE INVENTION

An electrophotographic image forming apparatus includes a developer device having a developer material bearing member which brings developer material, such as toner particles, onto an electrostatic latent image bearing member for development and a toner supply roller which is disposed in contact with the developer material bearing member and supplies toner particles to and collects them from the developer material bearing member at the contact area thereof.

The United States Patent Application No. 2001/0036376 A1 discloses such toner supply roller which includes a core bar and a form layer disposed around the circumference of the core bar. The circumferential layer is made of resin foam, such as urethane foam, or rubber foam, which can cause certain disadvantages due to the property of the material. For example, a foam layer made of a highly permeable material has an inferior ability of scraping off toner particles from the developer material bearing member, which results in that the toner particles on the developer material bearing member can not be replaced with fresh toner particles and thereby leads a degradation of toner particles. The degraded toner particles can only weakly adhere to the developer material bearing member due to the decrease in electric charge, which causes the toner particles to drop off from the developer device. A foam layer made of a material with low density will be pressed softly against a developer material bearing member, and therefore, can exercise less scraping-off ability. This may degrade toner particles on the developer material bearing member and will therefore tend to result in a possible dropping of the toner particles.

A foam layer made of a material of higher density, on the other hand, can be pressed against the developer material bearing member with a high pressure, which results in that a relative slide between the foam layer and the developer material bearing member can cause an invasion or implantation of the external additive into the surfaces of toner particles. This in turn deteriorates the functions of the external additive for providing a fluidity for toner particles and controlling electric charge therefor, for example.

Further, a foam layer made of a material with less hysteresis loss rate, i.e., a ratio of mechanical energy loss per deformation/recovery cycle, can readily recover from its deformation caused by the contact with the developer material bearing member and will therefore exercise a stable adhering to the developer material bearing member. This may result in a relative slide between the foam layer and the developer material bearing member and thereby the degradation and the resultant dropping of toner particles.

A foam layer made of a material with a higher hysteresis loss rate, on the contrary, exercises a less ability of adhering to the developer material bearing member and a less ability of toner scraping. This in turn results in a rapid degradation and a frequent dropping of the toner particles.

As described above, such inconvenience will occur unless the material of a foam layer of a toner supply roller has a proper air permeability, a proper density and a proper hysteresis loss rate.

SUMMARY OF THE INVENTION

Accordingly, a purpose of the present invention is to provide appropriate properties for an outer circumferential foam layer of the supply roller and thereby to prevent deterioration and dropping of the developing material.

To this end, the foam layer is made of resin foam or rubber foam and having an air permeability of 5 $ml/cm^2/s$ or less, a density of 50-200 $kg/m^3$, and a hysteresis loss ratio of 35-45%.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 5 is a table showing the result of the tests made for Invention and Comparison samples.

DETAILED DESCRIPTION OF THE PREFERRED EMBODIMENTS

An embodiment of the present invention will now be described in detail with reference to the attached drawings. Although terminologies indicating specific directions and/or locations, such as "on", "under", "right", "left" and phrases including such terminologies will be used as necessary in the following descriptions, this intends to provide readers with a better understanding of the invention and those terminologies and phrases should not be used to limit the technical scope of the present invention.

Figure 1:
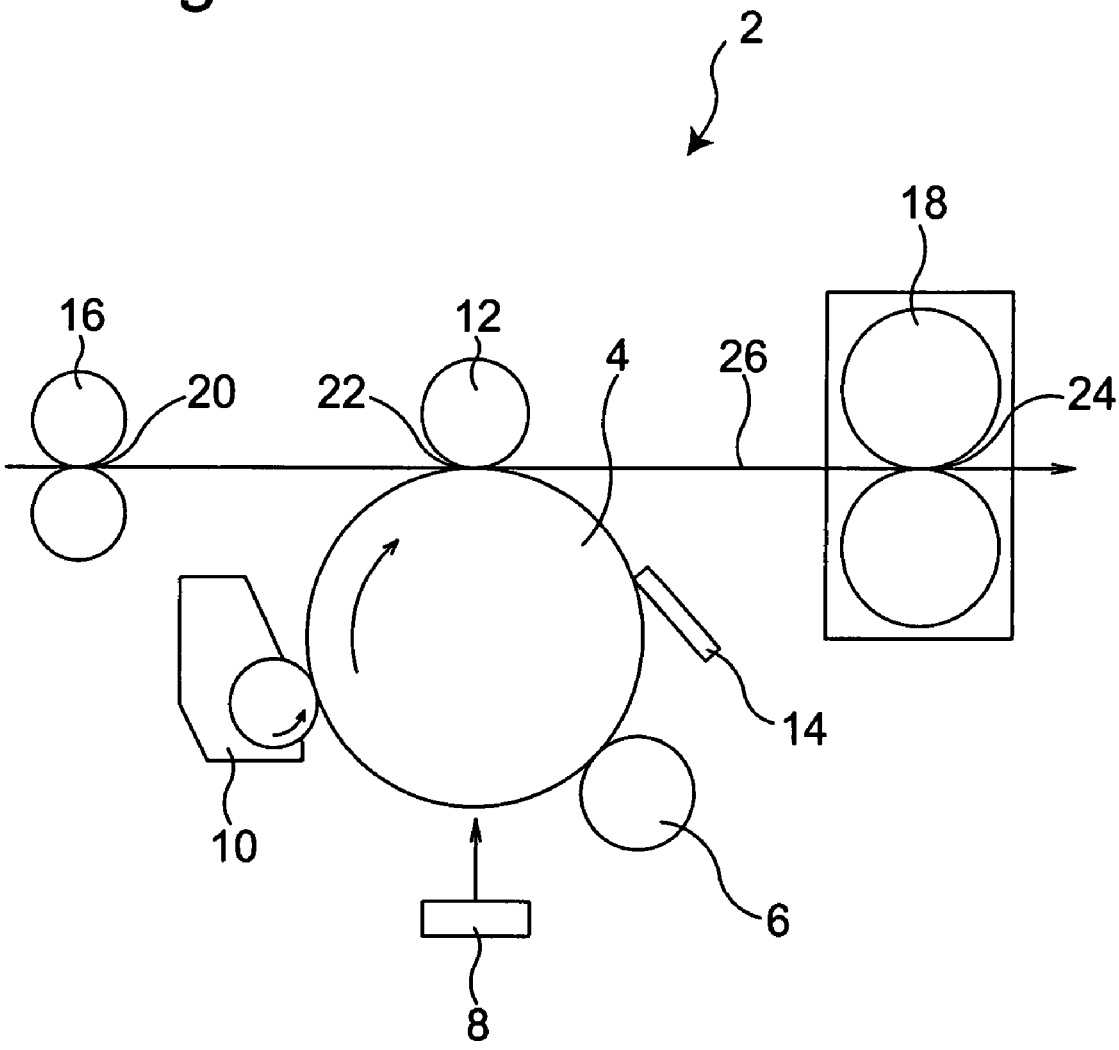
FIG. 1 is a schematic elevational view showing a general structure of the image forming apparatus according to the present invention.

FIG. 1 schematically shows an image forming apparatus 2 according to an embodiment of the present invention. For clarity, a housing of the image forming apparatus is not illustrated in FIG. 1.

The image forming apparatus 2 is an electrophotographic image forming apparatus which may be a copy machine, a printing machine, a facsimile machine and a multi-function machine equipped with functions of those machines in combination. While various types of electrophotographic image forming apparatuses have been proposed so far, the illustrated image forming apparatus is a monochrome image forming apparatus with a single developer device. The application of the present invention is not limited to the image forming apparatus and the present invention may also be applied to the so-called tandem type or the 4-cycle type full color image forming apparatus.

The image forming apparatus 2 includes an electrostatic latent image bearing member or cylindrical photosensitive member 4 in the form of drum. Disposed around the photosensitive member along the rotational direction of the photosensitive member, i.e., the clockwise direction in FIG. 1, are a charger device 6, an exposure device 8, a developer device 10, a transfer roller 12 and a cleaning member 14 in this order. The transfer roller 12 is mounted in contact with the photosensitive member 4 to define a contact area or nip region therebetween.

According to the embodiment, the cleaning member 14 is made of a blade in the form of elongate plate and is so mounted that its longitudinal edge is in contact with the outer circumference surface of the photosensitive member 4. The cleaning member 14, however, is not limited to such blade and a rotatable or fixed brush and roller may be used instead.

A transportation path 26 extends from a paper feeder not shown to a paper receiver not shown via a nip region 20 defined between paired paper feeder rollers 16, the transfer region 22 and a nip region 24 between paired fixing rollers 18.

A typical image forming operation will now be briefly described. The charger device 6 electrically charges the outer circumference surface of the photosensitive member 4 being rotated at a predetermined circumferential velocity. The exposure device 8 projects light corresponding to image data onto the charged outer circumference surface of the photosensitive member 4 to from an electrostatic latent image thereon. The electrostatic latent image is then visualized with toner particles of a developer material supplied from the developer device 10. The resultant toner image formed on the photosensitive member 4 is transported into the transfer region 22 by the rotation of the photosensitive member 4.

In synchronism with this toner image formation, a recording medium such as paper is transported from the paper feeder into the transportation path 26 and then conveyed to the transfer region 22 by the rotation of rollers 16. In the transfer region 22, the toner image on the photosensitive member 4 is transferred onto the paper. The paper bearing such transferred toner image is transported toward the downstream side on the transportation path 26, and after fixing of the toner image on the paper by the fixing rollers 18, discharged onto the paper receiver.

The toner particles remaining on the photosensitive member 4 without being transferred onto the paper, upon arrival at a contact area between the photosensitive member 4 and the cleaning member 14, are scraped off by the cleaning member 14 and accordingly removed from the outer circumference surface of the photosensitive member 4.

Figure 2:
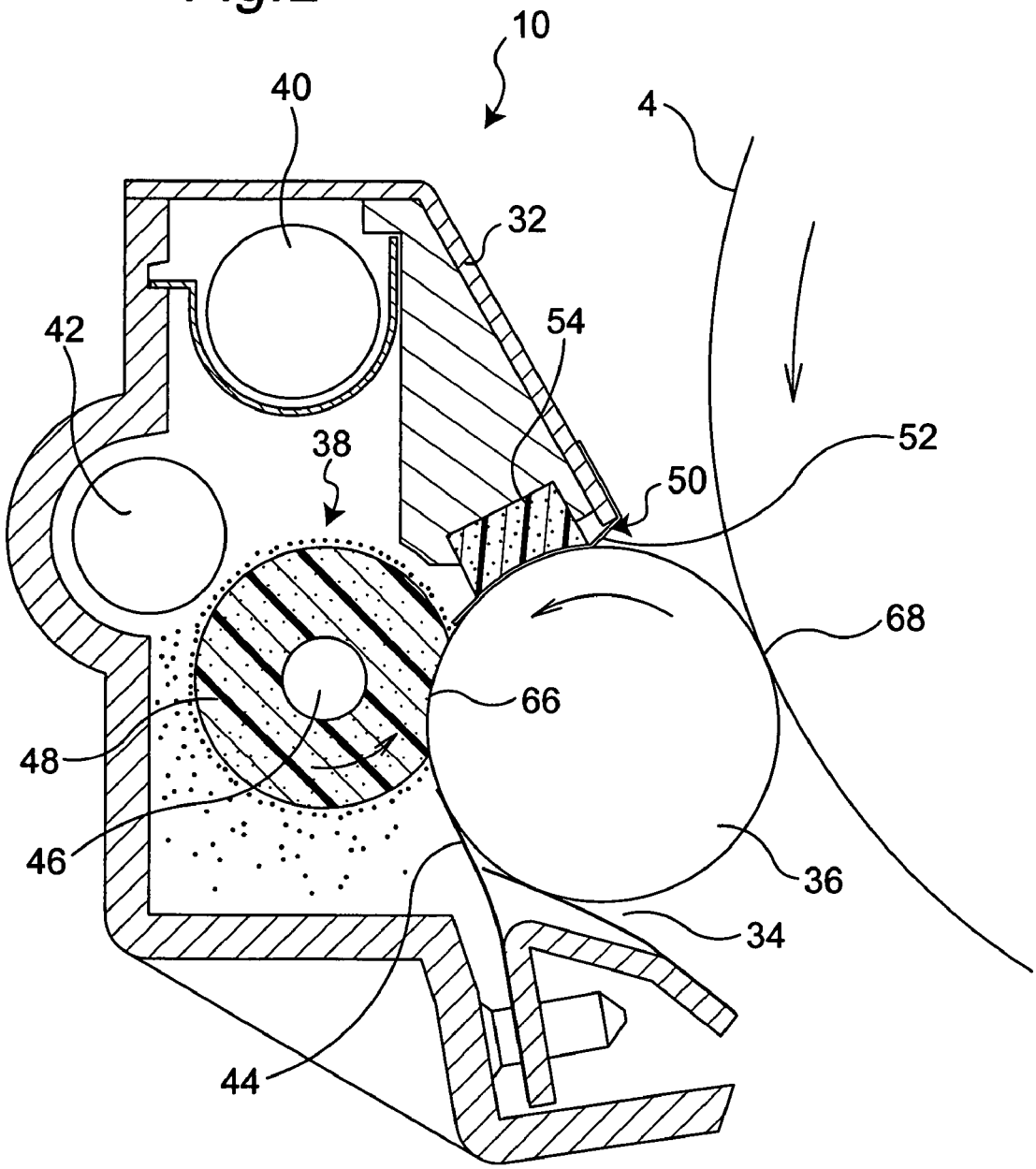
FIG. 2 is a cross sectional view of a developer machine of the image forming apparatus of FIG. 1.

The structure of the developer device 10 will now be described in detail. As shown in FIG. 2, the developer device 10 includes a developing roller 36 serving as a developer material bearing member, a toner supply roller 38 and a housing 32 which houses the developing roller 36 and the toner supply roller 38.

The toner is a so-called single component toner, for example. An external additive containing titanate strontium or the like may be added to the toner. Each toner particle has a diameter of about 6-7 μm but it is not limited thereto.

The developing roller 36 and the toner supply roller 38 are disposed in contact with each other so as to rotate about respective parallel shafts. The developing roller 36 and the toner supply roller 38 are drivingly linked to a drive source not shown, and by the driving of the drive source, rotate in the counterclockwise direction in FIG. 2. The specific structure of the toner supply roller 38 will be described later.

The developer device 10 further includes two transportation members 40 and 42, preferably in the form of screws for the circulation and mixing of toner particles inside the housing 32.

The housing 32 has an opening 34 for receiving the developing roller 36 which supplies toner particles onto the photosensitive member 4.

A discharge member 50, which is disposed in the vicinity of the opening 34 of the housing 32, includes an electrically conductive member 52 disposed in contact with the circumference of the developing roller 36 and a forcing member 54 which forces the conductive member 52 against the circumference of the developing roller 36.

The conductive member 52, preferably in the form of sheet, is secured at its one end to an upper edge of the opening 34. The remaining portion of the conductive member 52 is placed on the outer circumference surface of the developing roller 36. The conductive member 52 is selected from electrically conductive materials capable of being charged to the same polarity as the toner particle, such as polytetrafluoroethlene.

The forcing member 54 is supported by the housing 32 so that it cooperates with the developer roller 36 to hold the electrically conductive member 52 therebetween. Preferably, the forcing member 54 is made of, for example, resin foam, rubber foam, or felt. In this embodiment, the forcing member 54 is made of urethane foam.

In operation of the developing device 10 so constructed, the toner particles within the housing 32, in particular around the supply roller 38, are circulated in the counterclockwise direction in FIG. 2 and supplied onto the developing roller 36 in a supply and collect region 66 where the developing roller 36 and the supply roller 38 are opposed to each other by the rotation of the supply roller 38. The toner particles supplied to the developing roller 36 are electrically charged, but not fully charged, by the frictional contacts with the developing roller 36 and the supply roller 38.

The toner particles on the developing roller 36 are then transported by its rotation into a restriction region where a restriction member 44 contacts the circumferential surface of the developing roller 36. In the restriction region, the toner layer is restricted to a predetermined thickness and the toner particles are fully charged electrically by the frictional contact with the restriction member. The fully charged toner particles are transported by the rotation of the developing roller 34 into the developing region 68 where the developing roller 34 faces the photosensitive member 4. In this region 68, the toner particles adhere to the electrostatic latent image, in particular imaging region thereof, to form the visualized toner image on the photosensitive member 4.

The toner particles remaining on the developing roller 36 passed through the developing region 68, without being transferred to the photosensitive member, are discharged by the contact with the conductive member 52 so that they can easily be removed from the developing roller. The discharged toner particles are then transported into the supply and collect region where they are collected from the developing roller by the supply roller 38.

The structure of the supply roller 38 will now be described in detail. The supply roller 38 is formed by a cylindrical core bar 46 and a foam layer 48 disposed on the outer circumference of the core bar 46.

Preferably, the core bar 46 is made of iron, stainless steel, aluminum or resin, for example. Also preferably, the surface of the core bar 46 is plated to prevent corrosion thereof.

Preferably, the foam layer 48 is made of resin foam or rubber foam. Among other thing, polyurethane foam is most preferably used due to its excellent durability. Other materials including thermoset resin such as epoxy resin and acrylic resin and foam of thermoplastic resin such as polyethylene and polystyrene are also used for the foam layer 48.

The foam layer 48 may contain an electrically conductive material as necessary. The conductive material may be an electronic conductive material such as conductive carbon, tin oxide and zinc oxide, or an ionic conductive material such as sodium perchlorate, lithium perchlorate, and various types of quaternary ammonium salts.

The conductivity may be provided by, for example, mixing the unfoamed material with the conductive material and then expanding foaming the mixture or by immersing the foamed substrate into a liquid including the conductive material.

A discussion will be made to a method for providing the conductivity to the polyurethane foam layer 48 in which polyurethane is first mixed with ionic conductive material and then foamed.

According to this method, polyol component is continuously supplied into a mixing head. Immediately before being supplied into the mixing head, the polyol component is added and mixed with nitrogen gas. The polyol component includes, for example, 20-40 parts by weight of polymer polyol commercially available from Mitsui Chemicals Inc. under the trade name of "POP24-30", 40-65 parts by weight of polyether polyol commercially available from Mitsui Chemicals Inc. under the trade name of "ED-37", 7 parts by weight of polyester polyol commercially available from Daicel Chemical Industries, Ltd. under the trade name of "PCL305", 2 parts by weight of nickel acetylacetenate serving as a metallic catalyst commercially available from OSi under the trade name of "LC-5615", 0.1 parts by weight of triethylenediamine-based amine catalyst commercially available from Chukyo Yushi Co., Ltd. under the trade name of "LV33", 10 parts by weight of a foam control agent commercially available from Nippon Unicar Co., Ltd. under the trade name of "L520", and 0-5 parts by weight of ionic conducting agent of trimethyloctylammonium chloride. The total amount of those three polyols, i.e., polymer polyol, polyether polyol and polyester polyol, is 100 parts by weight.

Simultaneously with the continuous supply of polyol, polyisocyanate commercially available from Nippon Polyurethane Industry Co., Ltd. under the trade name of "MTL" is charged into the mixing head. The charging amount of polyisocyanate is so adjusted that equivalence ratio between the OH base of polyol and the NCO base of polyisocyanate ranges from 0.9 to 1.5.

Subsequently, the foam material thus mixed in the mixing head is fed to and, mixed in an Oaks mixer to obtain foamed material. The foamed material is then flown into a molding die.

The molding die is placed within a heating furnace having a temperature of 160° C., for example, where the foaming material is heated for 60 minutes, for example, and hardened. With this process, the electrically conductive foamed member is obtained.

A discussion will be made to a method for providing the conductivity to the foam layer 48, in which the foamed member is immersed in a liquid including a conductive material.

According to this method, an electronic conducting filler corresponding to the conductive material such as carbon powder (for example, carbon black and graphite), metallic powder of nickel, copper, silver, or a conductive metal oxide is dispersed in latex to obtain a liquid raw material. The latex may be obtained by stably dispersing solid resin such as polyurethane resin, acrylic resin, NBR, CR and polyester resin in water, or in liquid resin of polyurethane, silicon. Foam of polyurethane is impregnated with this liquid raw material and thereafter dried or cross-linked, thereby easily dispersing the electronic conducting filler in the foam. According to this process, the electrically conductive foam is obtained.

Figure 3:
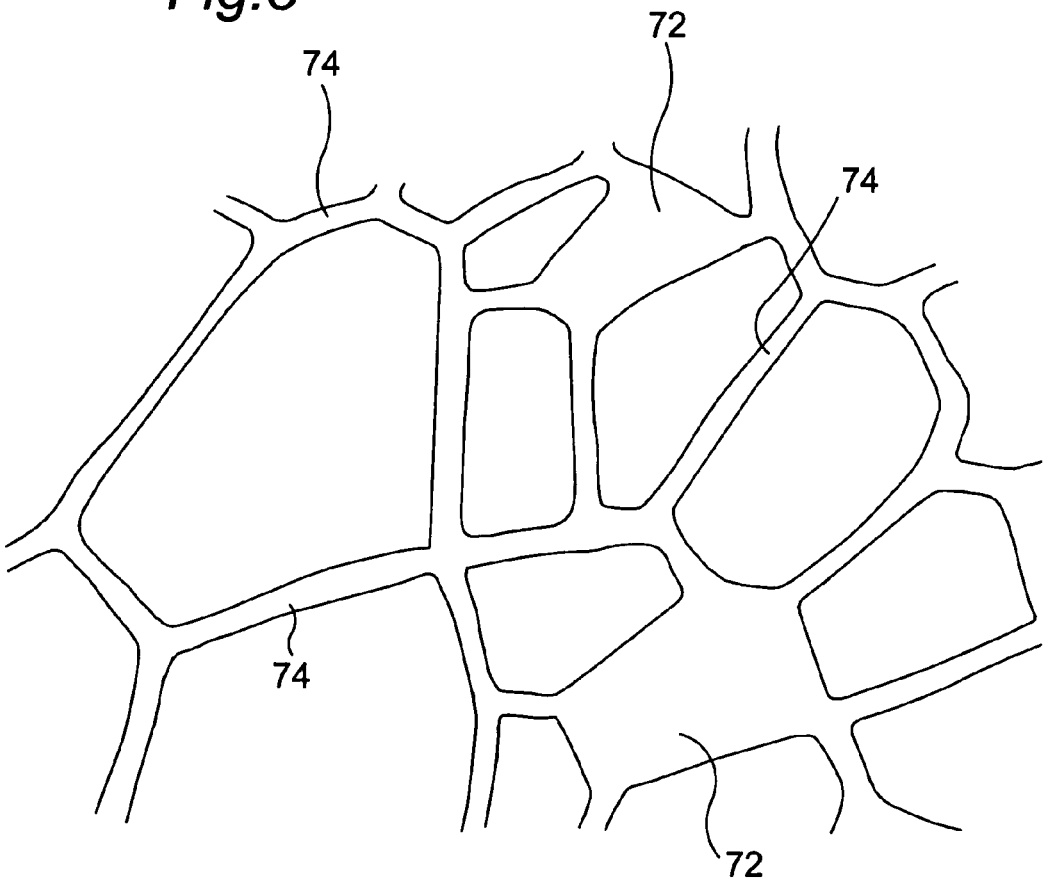
FIG. 3 is an enlarged partial drawing showing cell structures of the foam layer.

As shown in FIG. 3, the foam layer 48 includes a large number of highly-densed ultra small neighboring cells. A partition 72 or a pillar 74 may exist between neighboring cells. Typically, the neighboring cells are communicated to each other through opening or openings defined in the partitions 72, openings between the pillars 74 or openings between the partitions 72 and the associated pillars 74.

Preferably, an average effective diameter of the cells is 230 μm or more and then is far larger than that of the diameter of toner particle (about 6-7 μm). This allows each cell to accommodate therein a certain amount to toner without any difficulty, which enables the supply roller 38 to transport a sufficient amount of toner for forming images, in particular solid images with sufficient density, even when either or both of the developer roller 36 and the supply roller 38 are rotated at high speed.

Preferably, the air permeability of the foam layer 48 is 5 $ml/cm^2/s$ or less when measured in accordance with the Japanese Industrial Standard (JIS)-L1096A. This secures sufficient scraping of toner particles off from the developing roller 36 and achieves favorable replacement of toner particles on the developing roller 36. This minimizes the degradation of the toner particles and ensures a sufficient amount of toner to adhere onto the developing roller 36, which in turn prevents droppings of the toner particles from the developer device 10.

The air permeability of the foam layer 48 may be controlled by various ways, for example, by introducing flammable gas into expanded foam to burn out partitions around the cells of the foam and thereby to form cell-communication openings.

Preferably, the density of the foam layer 48 ranges from 50 $kg/m^3$ to 200 $kg/m^3$.

The foam layer 48 having a density of 50 $kg/m^3$ or more is sufficiently forced against the developing roller 36, which enhances its toner scraping property. This minimizes the degradation of the toner particles and ensures a sufficient amount of toner to adhere onto the developing roller 36, which in turn prevents droppings of the toner particles.

Meanwhile, the form layer having a density of 200 $kg/m^3$ or less prevents the foam layer 48 from being forced excessively against the developing roller 36, which restricts external additives from being implanted into the toner particles.

The air permeability of the foam layer 48 can be controlled by various ways, for example, by choosing the material of the foam layer 48 and/or increasing or decreasing the amount of forming agent added.

Preferably, the hysteresis loss ratio of the foam layer 48 ranges from 35% to 45%, which can be measured in accordance with JIS-K6400.

The hysteresis loss ratio is a ratio of a mechanical energy loss per deformation/recovery cycle, i.e., indicative of how difficult it is for the layer to restore its shape upon release from the compressed state. This means that the foam layer 48 with increased hysteresis loss ratio takes more time for recovering from deformation caused by the contact with the developing roller 36 and therefore provides a less adhesivity to the developing roller 36. The foam layer 48 with decreased hysteresis loss ratio, on the other hand, takes less time for recovering from deformation caused by the contact with the developing roller 36 and therefore provides a higher adhesivity to the developing roller 36.

The increased hysteresis loss ratio of the foam layer 48, i.e., 35% or more, prevents it from being forced excessively and thereby prevents the degradation and the resultant dropping of the toner particles.

Meanwhile, the foam layer 48 with hysteresis loss ratio of 45% or less ensures a sufficient adhesivity to the developing roller 36 and an improved scraping operation. In addition, the toner particles on the developing roller 36 are replaced well by fresh toner particles, which inhibits unwanted dropping of the toner particles.

The hysteresis loss ratio of the foam layer 48 may be controlled by different ways, for example, by changing the material of the foam layer 48, the composition ration of the material, and/or increasing or decreasing the amount of electrically conductive additive or additives. The surface of the foam layer 48 may be coated with a film of resin. In this instance, the hysteresis loss ratio can be controlled by changing the type or the amount of the resin used as the film.

Preferably, the electric resistance of the supply roller 38 ranges from $10^3\Omega$ to $10^9\Omega$. The electric resistance of $10^3\Omega$ or more prevents any voltage leakage upon application of a bias voltage between the developing roller 36 and the supply roller 38. Preferably, the electric resistance of $10^9\Omega$ or less secures a sufficient transportation of toner particles from the supply roller 38 to the developing roller 36, due to the bias application between the developing roller 36 and the supply roller 38.

EXAMPLES 18 samples made of materials with different properties, i.e., samples 1-6 according to the present invention (hereinafter each referred to as "Invention Example") and samples 1-12 (hereinafter each referred to as "Comparison Example", were prepared and tested for evaluation of their capabilities.

Each of 18 samples included polyurethane foam material as a base material. An ionic conducting agent, in particular, trimethyloctylammonium chloride was added to the samples of Invention Examples 1-4, Invention Example 6, and Comparison Examples 1-10, and carbon black was added as a conducting agent to Invention Example 5 and Comparison Example 12. No electrically conducting agent was added to the sample of Comparison Example 11.

Addition of the ionic conducting agent to the samples of Invention Examples 1-4, and 6, and Comparison Examples 1-10 was achieved by means of expansion of the ionic conducting agent as it was mixed with the raw material of polyurethane foam. Addition of carbon black to the samples of Invention Example 5 and Comparison Example 12 was conducted by means of impregnation of acrylic emersion containing carbon black with polyurethane foam and subsequent drying. Using the samples, toner supply rollers each with foam layer were fabricated.

A method of fabricating the toner supply rollers with foam layers will be described. Specifically, the samples were cut into rectangles each having a size of 40×40×300 mm. For each sample, a bore having a diameter of 6 mm was formed for insertion of the metal bar. A hot melt adhesive was applied on the peripheral surface of each metal bar by using a roll coater. The resultant metal bar had an outer diameter of 8 mm and was inserted into the bore of the sample. Then, the metal bar was heated by an electro-magnetic induction heater to melt the adhesive for providing a better bonding between the metal bar and the surrounding foam layer. Subsequently, the metal bar was cooled. Finally, each foam sample was cut to have an outer diameter of 14.8 mm.

The air permeability, the density, the hysteresis loss ratio, the resistance and the average effective cell diameter of each sample were measured. The measurement result is shown in FIG. 5.

The air permeability was measured in accordance with the JIS-L1096A under a differential pressure of 125 Pa, using Frazier Air Permeability Tester.

Figure 4:
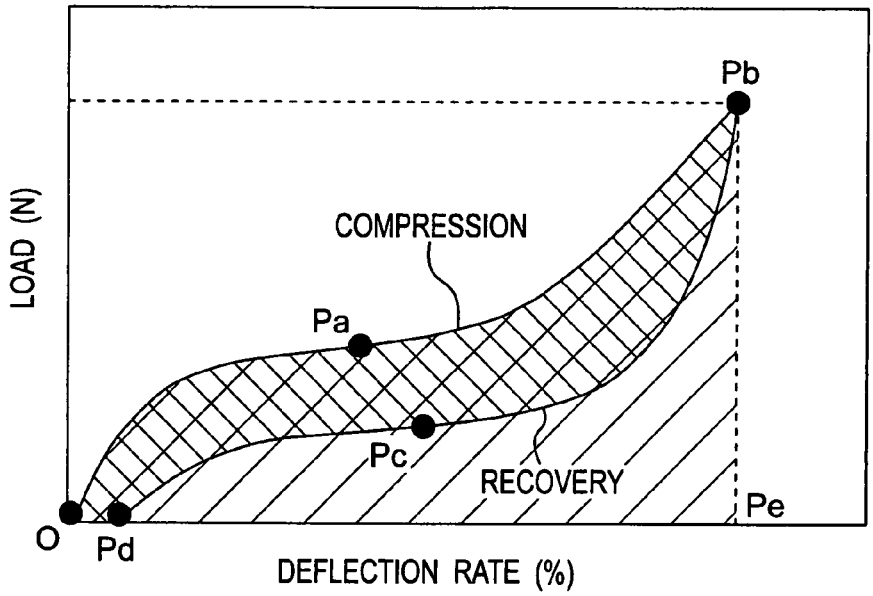
FIG. 4 is a graph of a load versus deflection curve for use in calculation of a hysteresis loss ratio.

The density was calculated for each sample from its volume and mass. The hysteresis loss ratio was calculated in accordance with JIS-K6400. Specifically, samples each having the size of 100×100×50 mm were placed on a fixed base in the stress-strain measuring system. A circular plate having a diameter of 200 mm was placed on the samples and then the samples were compressed by 75% of their original thicknesses so that the compressed samples had a 25% thickness of the original. Immediately thereafter, the samples were released from compression. The samples were then left still for three to five minutes. Again, the samples were compressed by moving the plate toward the base at the speed of 30 mm/min by 25% of their original thickness so that the compressed samples had a 75% thickness of the original. The plate was then moved away from the base at the same speed as that at compression, removing the compression force from the samples. The compression load, the deflection of the plate, and the deflection rate of the samples during the movement of the plate to and from the base were measured. From the measurements, the load versus deflection curves at compression and at recovery were obtained and shown in FIG. 4. Using the curves, the hysteresis loss ratio was calculated by the use of following relationship:

$$H.L.R=100\cdot A(1)/A(2)$$

wherein

H.L.R: Hysteresis Loss Ratio (%),

A(1): Cross Hached Area surrounded by lines connecting points O, Pa, Pb, Pc, Pd and O in FIG. 4, and A(2): Hached Area surrounded by lines connecting points O, Pa, Pb, Pc, Pe and O in FIG. 4.

The electric resistance of the supply roller was determined by placing it on a flat copper plate with a load of 0.98 (100 gf) applied at the both ends of the core bar of the supply roller and then measuring the electric resistance between the core bar and the flat plate. In this measurement, DC voltage of 10 V was applied between the core bar and the flat plate. The electric resistance was calculated by the use of a current value which was measured after five seconds from the voltage application.

The average effective cell diameter of the foam layer was determined by the use of three pictures taken by a scanning electron microscope (SEM) in different fields at the magnification of 35×. In each picture, the effective diameters of 50 cells were measured. The average effective cell diameter was calculated using 150 measurements in total.

The characteristics of each sample were evaluated in terms of implantation of the additive into toner particles, scraping ability and dropping of toner particles.

The evaluation of the implantation of additive into toner particles was conducted as follows.

First, using a fluorescent X-ray spectrometer, the content P(1) (%) of the external additive added to fresh toner particles was determined. Then, the fresh toner particles was cleaned and the content P(2) (%) of the external additive added to thus cleaned fresh toner particles was determined. Specifically, after cleaning, the fresh toner particles were immersed in a triton solution (i.e., a polyethyleneglycol alkylphenylether solution) for three minutes using an ultrasonic cleaning machine, the toner particles were maintained overnight. The external additives weakly adhering to the toner particles were separated from the toner particles and dispersed in the solution. The supernatant liquid of this solution was subjected to decantation, and the toner particles, i.e., sediments, were collected. The collected toner particles were dried for about 12 hours using a vacuum drying machine, and the content P(2) (%) of the external additive was determined using a fluorescent X-ray spectrometer. Using the contents P(1) (%) and P(2) (%) of the external additive, the implantation or adhering ability P(3) (%) of the fresh toner particles was calculated by the following equation:

$$P(3)=100\cdot P(2)/P(1)$$

The implantation or adhering ability of the used toner particles was evaluated as follows. A toner cartridge for Magicolor 7300 (manufactured by Konica Minolta Business Technologies, Inc.) was prepared for the developer machine. Also, an external drive machine for driving the developer device was assembled only for this evaluation. The external drive machine was adjusted so as to rotate the developer and supply rollers at rotational speeds of 140 rpm and 155 rpm, respectively. No voltage was applied between the developing roller and the supply roller so that they had the same electric potential. Each sample roller was assembled into the developer device. The developer device was loaded with 50 grams of magenta toner for Magicolor 7300. The developer device was driven continuously for four hours. Then, the developer device was disassembled and the toner particles were removed. For each removed toner, the content of the external additive before cleaning Q(1) (%) and the content of external additive after cleaning Q(2) (%) were determined. Also, the implantation or adhering ability Q(3) (%) of the used toner was calculated by the following equation:

$$Q(3)=100\cdot Q(2)/Q(1)$$

Using P(3) and Q(3), an increase (%) of the implantation or adhering ability was calculated as follows:

$$\text{Increase of Adhering Ability (\%)}=Q(3)-P(3)$$

The result of the evaluation is indicated in FIG. 5 in which symbol "A", "B", "C" mean that the increase of the adhering ability were equal to or less than 5%, more than 5% but equal to or less than 10%, and more than 10%, respectively.

A toner cartridge for Magicolor 7300 (manufactured by Konica Minolta Business Technologies, Inc.) was prepared for the developer machine. Also, an external drive machine for driving the developer device was assembled only for this evaluation. The external drive machine was adjusted so as to rotate the developer and supply rollers at rotational speeds of 140 rpm and 155 rpm, respectively. No voltage was applied between the developing roller and the supply roller so that they had the same electric potential. Each sample roller was assembled into the developer device. The remaining toner particles on the developer roller were removed by the use of compressed air and then wiped off completely by cloth. The developer device was loaded with 50 grams of magenta toner for Magicolor 7300.

The developer device was switched on and then immediately off so that the developer roller and the supply roller made a single rotation. The toner particles on the developing roller retained by the rotation were sampled. Hereinafter, the sampled toner is referred to as "toner sample A". Next, the developer device was driven for 30 seconds and then the toner particles on the developer roller were sampled. Hereinafter, the sampled toner is referred to as "toner sample B".

For samples A and B, a volume particle size distribution was measured using FPIA-2100 (manufactured by Sysmex Corporation). The particle size distribution serves as an indicator which expresses at which rates particles having which diameters are contained (i.e., relative particle weights to the total of 100%)

The particle size distribution of the toner samples A and B were respectively replaced with cumulative distributions indicative of a percentage ratio of the particles having a particular particle diameter or larger diameters.

Ten particle diameter levels were set and numbered from the first level to the tenth level, starting with the smallest one. With reference to the first particle diameter level, a particle size distribution value representing the first rotation was defined $X_1$ and a particle size distribution value after thirty seconds was defined $Y_1$, whereas with reference to the n-th particle diameter level, a particle size distribution value representing the first rotation was defined Xn and a particle size distribution value after thirty seconds was defined Yn. As for points Pn (Xn, Yn) thus defined, namely, $P_1$ through $P_{10}$, a standard SN ratio was calculated by a known formula for standard SN ratio calculation.

The standard SN ratio expresses a ratio between a signal (S: signal) and an error (N: noise) as a digital value, and the larger a standard SN ratio value is, the smaller an error is. In other words, as the value of the standard SN ratio calculated as described above is increased, changes of the first-round particle size distribution and the particle size distribution after thirty seconds become smaller.

With poor scraping ability of the supply roller, the toner replacement on the developing roller is unlikely to occur frequently, which results in that the toner particles having small diameters in particular tend to remain adhered to and staying on the developing roller. This increases the proportion of small diameter particles to the toner. As a result, the particle size distribution of toner samples A and B greatly change and the value of the SN ratio decreases. On the contrary, with improved scraping ability of the supply roller, the particle size distributions of samples A and B change slightly and the value of the SN ratio increases.

In light of this, the scraping ability was evaluated in terms of a standard SN ratio value. The result is indicated in FIG. 5, in which symbols "A", "B", "C" mean that SN ration were equal to or more than 27 db, more than 25 db but less than 27 db, and less 25 db, respectively.

The dropping of toner particles was evaluated as follows. In this evaluation, four toner cartridges for Magicolor 7300 (manufactured by Konica Minolta Business Technologies, Ltd.) were used. Each sample roller was assembled into the developer device. 200 grams of toner in different colors (yellow, magenta, cyan and black toners) for Magicolor 7300 were loaded into respective developer devices.

The developer devices were then set to the image forming apparatus, and in Low-temperature and L-humidity (LL) environment with the ambient temperature of 10° C. and the humidity of 15%, blank images were printed on 10,000 sheets. The number of sheets onto which the toner particles dropped on during the printing was counted, and a toner dropping was evaluated in terms of the number of sheets tainted with dropped toner particles. The result is indicated in FIG. 5, in which symbols "A", "B", "C" mean that the number of sheets on which the toner particles dropped were equal to or less than 500, more than 500 but equal to or less than 1,000, and more than 1,500, respectively.

Another test was made to confirm other problems which would cause in the process of image formation. In this test, four toner cartridges for Magicolor 7300 (manufactured by Konica Minolta Business Technologies, Ltd.) were used. Each sample roller was assembled into the developer device. 200 grams of toner in different colors (yellow, magenta, cyan and black toners) for Magicolor 7300 were loaded into respective developer devices.

The developer devices were then installed in the image forming apparatus. Using the image forming apparatus, images were formed on the papers. Printed images were visually inspected to confirm whether there were development-induced problems such as insufficient image densities, creation of image defects and creation of noises caused by a voltage leakage between the developer and supply rollers.

As a result, the toner dropping occurred when using made of samples of Comparison Examples 1, 4, 6 and 7 with air permeabilities more than 5 ml/cm$^2$/s.

No toner dropping occurred in the test using Invention Example 6 having air permeability of less than 0.32 ml/cm$^2$/s. This shows that the lowermost limit value of an optimal air permeability range may be 0.32 ml/cm$^2$/s or less.

Rollers made of samples of Comparison Examples 1 and 2 having densities of less than 50 kg/m$^3$ caused toner dropping and exhibited poor scraping ability. Rollers made of samples of Comparison Examples 3, 4 and 8 having densities more than 200 kg/m$^3$ caused the implantation of the external additive into the toner particles.

Rollers made of samples of Comparison Examples 5 and 7 with the hysteresis loss ratios of lower than 35% caused toner dropping. Meanwhile, rollers using samples of Comparison Examples 3, 4, and 9 with the hysteresis loss ratios higher than 45% showed poor scraping ability and caused toner dropping.

Roller made of sample of Comparison Example 5 with appropriate air permeability and the density caused relatively less toner dropping. It can be understood that the toner dropping is attributable more to air permeability and density of the foam layer than to the hysteresis loss ratio of the foam layer.

The supply rollers made of sample of Comparison Example 12, with electric resistance value of less than $10^3\Omega$, caused noises in the printed images. It can be understood that this is caused by the voltage leakage between the developing roller and the supply roller. On the contrary, the supply roller made of sample of Comparison Example 11 with electric resistance value beyond $10^9\Omega$ caused insufficient densities and defects in the printed images.

Rollers of samples of Comparison Examples 3, 4, 7, 8, and 10 with the average effective cell diameters of less than 230 μm caused insufficient densities of the printed images. On the contrary, rollers made of samples of Invention Examples 1-6 showed excellent abilities in all aspects.

In view of foregoing, it was confirmed that a foam layer of a supply roller preferably exhibits air permeability of 5 ml/cm$^2$/s or less, density of 50 kg/m$^3$ to 200 kg/m$^3$ and hysteresis loss ratio of 35% to 45%. Also confirmed is that the electric resistance value of the supply roller preferably ranges from $10^3\Omega$ to $10^9\Omega$ and that the average effective cell diameter of the foam layer preferably is 230 μm or larger.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A developer supply roller, comprising:

an outer circumferential foam layer, the foam layer being made of resin foam or rubber foam and having an air permeability of 5 ml/cm$^2$/s or less, a density of 50-200 kg/m$^3$, and a hysteresis loss ratio of 35-45%.

2. The developer supply roller of claim 1, wherein the foam layer has an electric resistance of $10^3$-$10^9\Omega$.

3. The developer supply roller of claim 1, the foam layer includes a number of small neighboring cells, each of the cells having an average effective diameter of 230 μm or larger.

4. The developer supply roller of claim 1, the air permeability of the foam layer is 0.32-5 ml/cm$^2$/s.

5. The developer supply roller of claim 1, the foam layer is made of polyurethane foam.

6. A developer apparatus, comprising:

a developer material bearing member;

a housing adapted to accommodate a developer material; and a supply roller adapted to supply the developer material within the housing for the developer material bearing member, the supply roller having an outer circumferential foam layer, the foam layer being made of resin foam or rubber foam and having an air permeability of 5 ml/cm$^2$/s or less, a density of 50-200 kg/m$^3$, and a hysteresis loss ratio of 35-45%.

7. The developer apparatus of claim 6, wherein the foam layer has an electric resistance of $10^3$-$10^9\Omega$.

8. The developer apparatus of claim 6, the foam layer includes a number of small neighboring cells, each of the cells having an average effective diameter of 230 μm or larger.

9. The developer apparatus of claim 6, the air permeability of the foam layer is 0.32-5 ml/cm$^2$/s.

10. The developer apparatus of claim 6, the foam layer is made of polyurethane foam.

11. An image forming apparatus, comprising:

an electrostatic latent image bearing member capable of bearing an electrostatic latent image thereon; and a developer apparatus having a developer material for visualizing the electrostatic latent image into a visualized image, the developer apparatus comprising:

a developer material bearing member;

a housing adapted to accommodate a developer material; and a supply roller adapted to supply the developer material within the housing for the developer material bearing member, the supply roller having an outer circumferential foam layer, the foam layer being made of resin foam or rubber foam and having an air permeability of 5 ml/cm$^2$/s or less, a density of 50-200 kg/m$^3$, and a hysteresis loss ratio of 35-45%.

12. The image forming apparatus of claim 11, wherein the foam layer has an electric resistance of $10^3$-$10^9\Omega$.

13. The image forming apparatus of claim 11, the foam layer includes a number of small neighboring cells, each of the cells having an average effective diameter of 230 μm or larger.

14. The image forming apparatus of claim 11, the air permeability of the foam layer is 0.32-5 ml/cm$^2$/s.

15. The image forming apparatus of claim 11, the foam layer is made of polyurethane foam.

* * * * *